US012618014B2

(12) United States Patent
Al-Eid et al.

(10) Patent No.: US 12,618,014 B2
(45) Date of Patent: May 5, 2026

(54) COMPOUNDS FOR BREAKING EMULSIONS

(71) Applicants: Saudi Arabian Oil Company, Dhahran (SA); King Fahd University of Petroleum and Minerals, Dhahran (SA)

(72) Inventors: Manal Al-Eid, Dhahran (SA); Laila S. Alsaihati, Al Kawthar (SA); Donya A. Alsewdan, Dhahran (SA); Rashed Mohammad Aleisa, Dhahran (SA); Muhammad Imran Ulhaq, Dhahran (SA); Shaikh Asrof Ali, Dhahran (SA)

(73) Assignees: Saudi Arabian Oil Company, Dhahran (SA); King Fadh University of Petroleum and Minerals, Dharan (SA)

( * ) Notice: Subject to any disclaimer, the term of this patent is extended or adjusted under 35 U.S.C. 154(b) by 0 days.

(21) Appl. No.: 18/311,332

(22) Filed: May 3, 2023

(65) Prior Publication Data

US 2024/0368483 A1 Nov. 7, 2024

(51) Int. Cl.
*C10G 33/04* (2006.01)

(52) U.S. Cl.
CPC ..... *C10G 33/04* (2013.01); *C10G 2300/80* (2013.01)

(58) Field of Classification Search
CPC ..... C10G 33/04; C10G 2300/80
See application file for complete search history.

(56) References Cited

U.S. PATENT DOCUMENTS 4,420,413 A 12/1983 Diery et al.
5,445,765 A 8/1995 Elfers et al.
(Continued)

FOREIGN PATENT DOCUMENTS

CN 101352666 B * 8/2010
WO 2007115980 A1 10/2007
WO WO-2013132035 A1 * 9/2013 ..... C08G 65/22

OTHER PUBLICATIONS

CN-101352666-B English Translation; 2010.*
(Continued)

*Primary Examiner* — Ellen M Mcavoy
*Assistant Examiner* — Chantel Graham
(74) *Attorney, Agent, or Firm* — DINSMORE & SHOHL LLP

(57) ABSTRACT

A demulsifying agent may comprise the structure $R_1$ may be a hydrocarbyl group or heterohydrocarbyl group comprising from 1 to 20 carbon atoms. m may be from 2 to 10, n may be from 5 to 20, and p may be from 2 to 15. $R_2$ may comprise a residue of propylene oxide. $R_3$ may comprise a residue of glycidol. Embodiments of the present disclosure may further comprise methods of making the demulsifying agent and methods of using the demulsifying agent to demulsify a hydrocarbon emulsion.

20 Claims, 1 Drawing Sheet

(56) References Cited

U.S. PATENT DOCUMENTS

| | | | |
|---|---|---|---|
| 7,569,615 | B2 | 8/2009 | Leinweber et al. |
| 7,670,198 | B2 | 3/2010 | Shimizu |
| 2009/0197978 | A1 | 8/2009 | Patel et al. |
| 2009/0306232 | A1 | 12/2009 | Williams |
| 2012/0095112 | A1 | 4/2012 | Findlay et al. |

OTHER PUBLICATIONS

WO-2013132035-A1 English Translation; 2013.*
Ma et al., "A novel oxygen-containing demulsifier for efficient breaking of water-in-oil emulsions", Chemical Engineering Journal, vol. 385, Apr. 1, 2020.

* cited by examiner

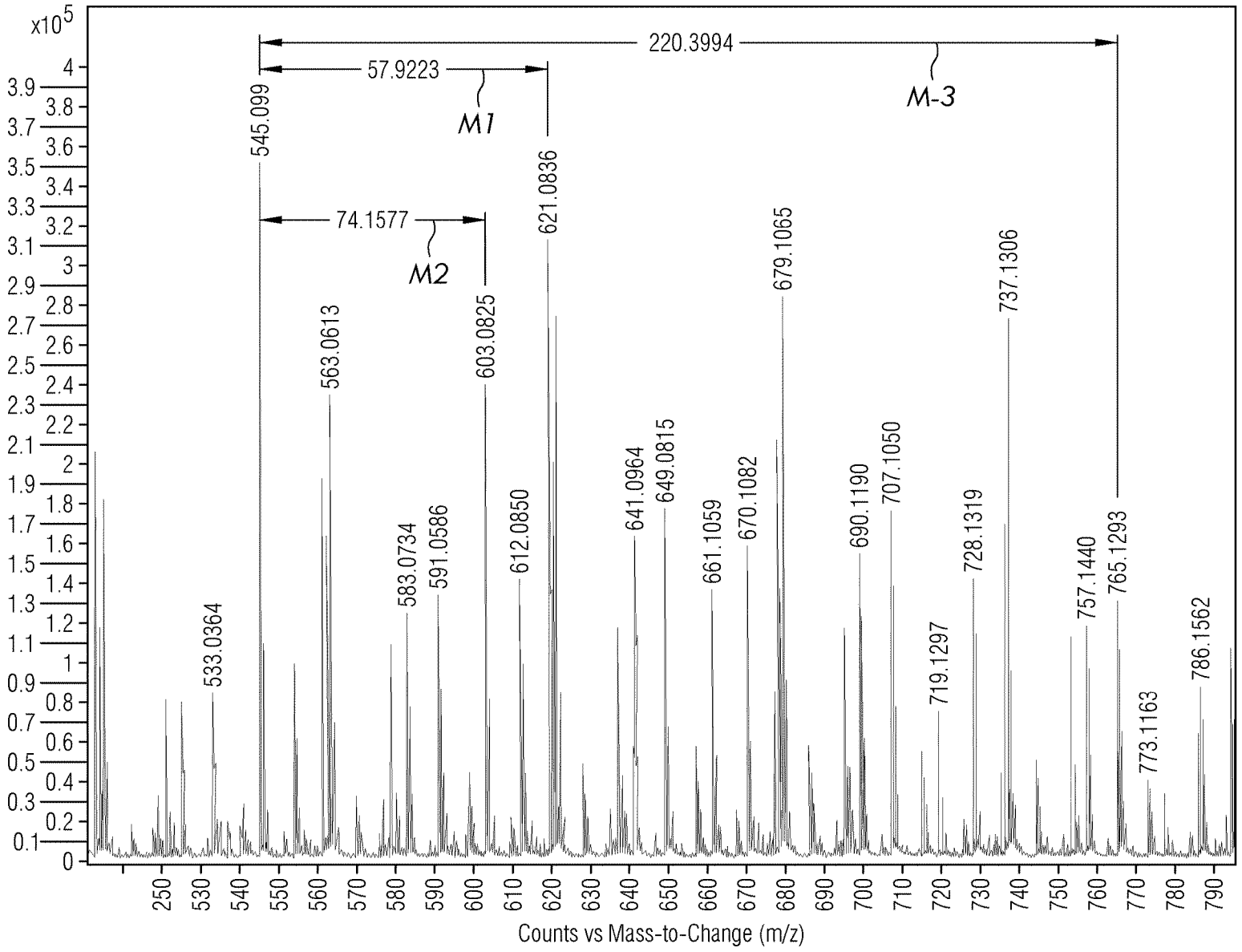
x10^5
Counts vs Mass-to-Change (m/z)
220.3994
57.9223
74.1577
M1
M2
M-3
545.099
533.0364
563.0613
583.0734
591.0586
603.0825
612.0850
621.0836
641.0964
649.0815
661.1059
670.1082
679.1065
690.1190
707.1050
719.1297
728.1319
737.1306
757.1440
765.1293
773.1163
786.1562

COMPOUNDS FOR BREAKING EMULSIONS

FIELD

The present disclosure relates to compounds and processes for breaking an emulsion, and to processes for making said compounds. In particular, the present disclosure relates to demulsifying agents, methods of making demulsifying agents, and processes for using demulsifying agents for breaking hydrocarbon-water emulsions.

TECHNICAL BACKGROUND

The formation of emulsions is a common issue which can occur at many stages during the production and processing of crude oils. The presence of water in crude oil, such as in an emulsion can contribute to corrosion of refinery equipment, poisoning catalysts used in downstream processing facilities, and increasing pumping costs for the transportation of oil in pipelines. Additionally, the presence of water in the crude oil can cause excessive pressure drop in flow lines, tripping equipment in the gas oil separation plant (GOSP) offline. Accordingly, it is important to remove water from the crude oil at certain points in the crude oil production and upgrading process.

Ethylene oxide grafted phenolic resins have long been used to break emulsions and remove water from crude oil. However, these emulsion breakers have insufficient performance. Additionally, ethylene oxide is a reactive, flammable gas which requires special process handling equipment. Additionally, ethylene oxide based demulsifying agents are insufficiently effective at breaking crude oil emulsions.

Accordingly, more effective demulsifying agents which can be produced with reduced need for flammable, reactive gasses and special handling equipment are desired.

BRIEF SUMMARY

Embodiments of the present disclosure meet this need by providing environmentally friendly, hyper-branched copolymers of phenol-formaldehyde resins for use as demulsifying agents. Specifically, the demulsifying agents of the present disclosure may comprise phenol residues, residues of propylene oxide, and residues of glycidol. Without being limited by theory, it is believed that the demulsifying agents of the present disclosure perform better than prior demulsifying agents due to increased numbers of hydrophilic groups, since combining functional hyper-branched compounds with the phenol resin structure allows multiple hydrophilic groups to coexist in a single branch of the demulsifying agent. These hydrophilic groups are believed to bind to water molecules, facilitating the separation of oil in water emulsions. Additionally, these demulsifying agents do not require the use of flammable ethylene oxide.

According to at least one aspect of the present disclosure, a demulsifying agent may comprise the structure

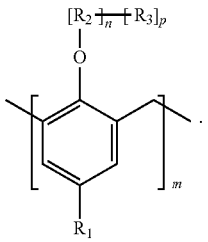

$R_1$ may be a hydrocarbyl group or heterohydrocarbyl group comprising from 1 to 20 carbon atoms. Subscript "m" may be from 2 to 10, subscript "n" may be from 5 to 20, and subscript "p" may be from 2 to 15. $R_2$ may comprise a residue of propylene oxide $R_3$ may comprise a residue of glycidol.

According to at least one aspect of the present disclosure, a method of making a demulsifying agent may comprise combining novolak solids with an aprotic solvent, a weak base, and an alcohol to form a novolak solution; drying the novolak solution to form a novolak residue; combining the novolak residue with propylene oxide under stirring to form a novolak-propylene oxide solution; reacting the novolak-propylene oxide solution to form a novolak-PPO solution; combining the novolak-PPO solution with glycidol to form a novolak-PPO-glycidol solution; reacting the novolak-PPO-glycidol solution to form a novolak-PPO-HPG solution; and drying the novolak-PPO-HPG solution to form the demulsifying agent.

According to at least one aspect of the present disclosure, a method of demulsifying a hydrocarbon emulsion may comprise combining a hydrocarbon feed with a demulsifying agent to form a hydrocarbon-demulsifying agent solution. The hydrocarbon feed may comprise water and hydrocarbons.

Additional features and advantages of the aspects of the present disclosure will be set forth in the detailed description that follows and, in part, will be readily apparent to a person of ordinary skill in the art from the detailed description or recognized by practicing the aspects of the present disclosure.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which:

FIG. 1 is a graphical depiction of electrospray ionization-mass spectrometry (ESI-MS) of some embodiments of the present disclosure.

DETAILED DESCRIPTION

The present disclosure is directed to demulsifying agents, methods of making demulsifying agents, and processes for demulsifying hydrocarbon feeds, such as crude oils. A demulsifying agent of the present disclosure may comprise a compound of structure I.

Structure I

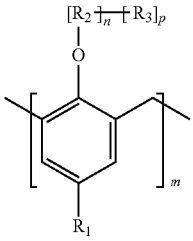

$R_1$ may be a hydrocarbyl group or heterohydrocarbyl group, $R_2$ may comprise a residue of propylene oxide, and $R_3$ may comprise a residue of glycidol.

Definitions

The term "alkyl" means a saturated hydrocarbon radical that may be linear or branched. Accordingly, the term "($C_1$-$C_{20}$) alkyl" means a saturated linear or branched hydrocarbon radical of from 1 to 20 carbon atoms that is unsubstituted or substituted. Examples of unsubstituted ($C_1$-$C_{20}$) alkyl include methyl; ethyl; 1-propyl; 2-propyl; 1-butyl; 2-butyl; 2-methylpropyl; 1,1-dimethylethyl; 1-pentyl; 1-hexyl; 1-heptyl; 1-nonyl; and 1-decyl. Examples of substituted ($C_1$-$C_{20}$) alkyl include trifluoromethyl and trifluoroethyl.

The term "heterohydrocarbyl" refers to a hydrocarbyl, from which at least one carbon atom has been replaced with a heteroatom. Examples of heteroatoms include, without limitation, oxygen, nitrogen, sulfur, and phosphorus.

The term "hydrocarbyl" means a monovalent radical resulting from removal of any hydrogen atom from a hydrocarbon, including aromatic hydrocarbons, non-aromatic hydrocarbons, cyclic or acyclic hydrocarbons, saturated or unsaturated hydrocarbons, straight chain or branched chain hydrocarbons, and substituted or unsubstituted hydrocarbons.

The term "hyper-branched polypropylene glycol" refers to a polypropylene glycol which comprises multiple residues of glycidol bonded together in a semi-random branching pattern.

The term "polymer" refers to an organic compound comprising repeating units. The polymers of the present disclosure may be derived from repeating subunits, such as residues of phenolic compounds, residues of propylene oxide, and residues of glycidol.

The term "residue" the product of a reactant, such as the moiety remaining from a monomer after the monomer is polymerized to form a polymer, or from a polymer in a block copolymer when the polymer is one of the blocks of the block copolymer. For example, polystyrene is a polymer composed of styrene residues, where each individual styrene residue in the polystyrene is derived from reacting a vinyl olefin of a molecule of styrene (a styrene monomer) in a polymerization reaction.

The hydrophilic-lipophilic balance ("HLB") is a measure of the hydrophobic and lipophilic character of a compound, such as an emulsion breaker. HLB measures the percentage of the molecular weight of a compound which is hydrophilic vs the percentage of the molecular weight of the compound which is lipophilic.

The relative solubility number ("RSN") is a measure of the hydrophobic-hydrophilic character of a compound, such as an emulsion breaker. The RSN may be determined by 1) mixing 97.4 wt. % of ethylene glycol dimethyl ether and 2.6 wt. % toluene to form a titration solvent, 2) mixing 30 ml of the titration solvent with 1 g of the demulsifying agent, 3) agitation the solution until the demulsifying agent is completely dissolved, 4) and adding water dropwise until the solution becomes turbid. The RSN is the number of mL required until the solution becomes turbid.

As used in this disclosure, wavy bonds signify chemical bonds between a chemical moiety shown and one not shown. For example, the wavy bond in

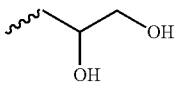

signifies a bond to another moiety, such as the one in

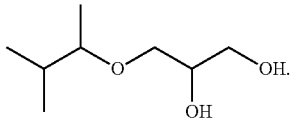

Similarly, lines which extend outside of brackets ([or]) refer to bonds between two monomers in a polymer. For example, the bonds crossing the brackets in

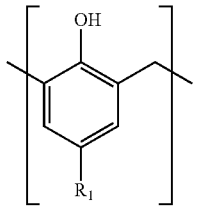

signify bonds to other monomers in the polymer, as is shown in

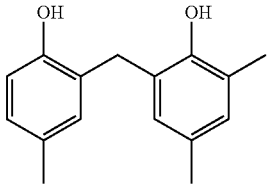

EMBODIMENTS

As discussed above, the demulsifying agent may comprise a polymer of structure I. The polymer of structure I may be useful for breaking hydrocarbon emulsions due to its multiple hydrophilic groups, which may bind to the water in the hydrocarbon emulsions. The structure of these demulsifying agents plays a significant role in the demulsification process, for example, by facilitating contact between the hydrophilic groups and the water droplets. The water in hydrocarbon emulsions may damage process equipment and decrease processing efficiency.

The demulsifying agent of structure I may comprise a novolak polymer of structure II, which may itself comprise phenol units. The phenol units may be formed from residues of phenol monomers.

Structure II

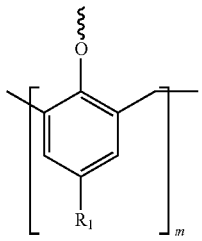

In embodiments, the novolak polymer may comprise from 2 to 10 phenol units (represented by subscript "m"), such as from 3 to 10, from 4 to 10, from 5 to 10, from 6 to 10, from 7 to 10, from 8 to 10, from 2 to 8, from 2 to 6, from 2 to 4, from 3 to 9, from 4 to 8, from 5 to 7, or any subset thereof, of phenol monomers. The length of the novolak polymer may strongly affect the polymer's performance as an emulsion breaker. Without being limited by theory, it is believed that the length of the novolak polymer may be one of the controlling factors in the polymer's hydrophilic-lipophilic balance ("HLB"), the polymer's relative solubility number ("RSN"), or both. The HLB and RSN of a polymer are believed to strongly affect the performance of the polymer as an emulsion breaker.

The novolak polymer of the demulsifying agent may include hydrocarbyl group or heterohydrocarbyl group $R_1$ with from 1 to 20 carbon atoms. In embodiments, the hydrocarbyl group or heterohydrocarbyl group of $R_1$ may comprise from 2 to 20, from 4 to 20, from 6 to 20, from 8 to 10, from 2 to 18, from 2 to 16, from 2 to 14, from 2 to 12, from 2 to 10, from 4 to 18, from 6 to 16, from 7 to 14, from 8 to 12, from 8 to 10, from 5 to 15, or 9 carbon atoms. In some embodiments, $R_1$ may be a hydrocarbyl group, such as an alkyl hydrocarbyl group, or a saturated, acyclic alkyl hydrocarbyl group. In embodiments, $R_1$ may be a saturated, linear alkyl hydrocarbyl group comprising 9 carbon atoms. $R_1$ may have a branched structure. In embodiments, $R_1$ may be a saturated, acyclic alkyl hydrocarbyl group with a branched structure, such as a saturated, acyclic alkyl hydrocarbyl group with a branched structure comprising 9 carbon atoms.

The demulsifying agent may comprise residues of propylene oxide, each residue of propylene oxide is designated $R_2$ in structure I. Together these residues of propylene oxide may form a polypropylene oxide, which is described graphically by structure III. $R_2$ may have the formula —(—$CH_2$—$CHCH_3$—O—)—, which results in a polymer with formula —(—$CH_2$—$CHCH_3$—O—)—$_n$.

Structure III

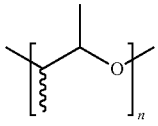

As discussed above, the use of residues of propylene oxide may provide better performance to the demulsifying agent than residues of ethylene oxide because propylene oxide residues provide an optimum degree of hydrophobicity to the demulsifying agent. Additionally, propylene oxide itself has better safety, cost, materials handling, and availability characteristics than ethylene oxide. Similarly, propylene oxide residues provide better performance to the demulsifying agent than butylene oxide residues because propylene oxide residues provide an optimum degree of hydrophobicity to the demulsifying agent. Propylene oxide also has better cost and availability characteristics than butylene oxide.

The polypropylene oxide ($[R_2]_n$) comprising residues of propylene oxide ($R_2$) may comprise from 5 to 20 propylene oxide residue ($R_2$) units, as represented by subscript "n". In embodiments, the polypropylene oxide may comprise from 5 to 18, from 5 to 16, from 5 to 14, from 5 to 12, from 5 to 10, from 5 to 8, from 5 to 6, from 7 to 20, from 9 to 20, from 11 to 20, from 13 to 20, from 15 to 20, from 17 to 20, from 19 to 20, from 7 to 18, from 9 to 16, from 11 to 14, or any subset thereof, propylene oxide residue ($R_2$) units. In embodiments, the polypropylene oxide may comprise 10 propylene oxide residue ($R_2$) units.

$R_3$ may comprise a residue of glycidol. Together, the residues of multiple glycidols may form a hyper-branched polyglycerol (referred to as $[R_3]_p$).

Each residue of glycidol $R_3$ may independently have structure IV, V, or VI below.

Structure IV

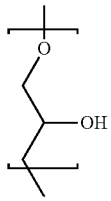

Structure V

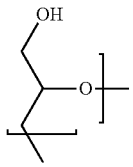

Structure VI

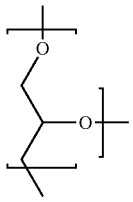

The polymerization of the glycidol may result in a hyper-branched polyglycerol $[R_3]_p$ with a branched structure. This branching may occur in a semi-random manner with units attaching at either of the oxygen atoms as is shown in structures IV and V, or at both of the oxygen atoms, as is shown in structure VI. Some embodiments of the hyper-branched polyglycerol structure $[R_3]_p$ are depicted in structures VII (subscript p=3), and VIII (subscript p=4). It should be understood that structures VII, and VIII are merely exemplary.

Structure VII

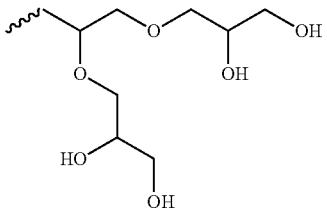

-continued

Structure VIII

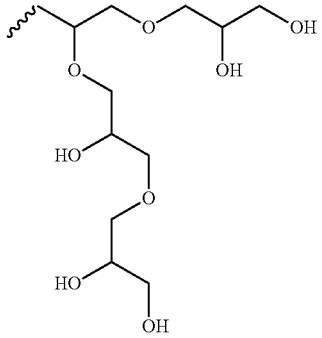

In embodiments, the hyper-branched polyglycerol $[R_3]_p$ may comprise at least one residue of glycidol which has another residue of glycidol bonded to each oxygen atom. A hyper-branched polyglycerol comprising at least one residue of glycidol which has another residue of glycidol bonded to each oxygen atom is shown in Structures VII and VIII.

The demulsifying agent may include a total of from 2 to 15 glycidol residue units, as represented by subscript "p". Accordingly, subscript p, representing the number of glycidol residue units $R_3$ in the demulsifying agent may be from 2 to 15, from 3 to 15, from 4 to 15, from 2 to 14, from 3 to 14, from 4 to 14, from 2 to 12, from 2 to 10, from 2 to 8, from 2 to 6, from 2 to 4, from 3 to 14, from 3 to 10, from 3 to 8, from 3 to 6, from 4 to 14, from 4 to 10, from 4 to 8, from 4 to 6, or 4.

Without being limited by theory, it is believed that the use of glycidol residues, with their large and branched structure, as the monomers within the hyper-branched polyglycerol, improves the degree of hyper-branching achievable by the demulsifying agent. It is further believed that the hyper-branching in the hyper-branched polyglycerol facilitates contact between the hydrophilic groups of the demulsifying agent and the water in the hydrocarbon emulsion.

In embodiments, each phenol unit of structure I may have a polypropylene oxide unit bonded directly to it, as depicted in structure IX. Without being limited by theory, it is believed that it may be beneficial to have a propylene oxide unit bonded to each phenol unit, as is shown in structure IX, because compounds which lack the propylene oxide bonded to each phenol unit may have a lower molecular weight and reduced coalescence of water droplets, relative to the embodiments with a propylene oxide bonded directly to each phenol unit.

In embodiments, only some of the phenol units of Structure I may have a polypropylene oxide directly bonded to them, as depicted in structure X. In embodiments, only one phenol unit of the novolak in structure I may have a polypropylene oxide bonded directly to it, as depicted in structure XI.

Structure IX

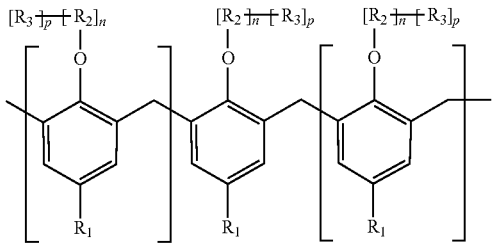

-continued

Structure X

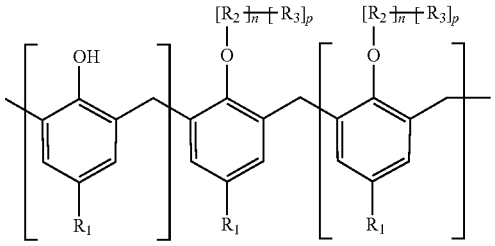

Structure XI

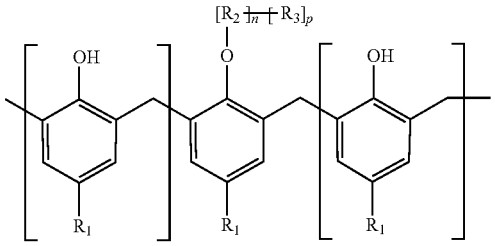

In the demulsifying agent, a ratio of subscript "m" to subscript "n" (representing the molar ratio of phenol units to residues of propylene oxide) may be from 1:5 to 1:20. In embodiments, a ratio of subscript m to subscript n may be from 1:5 to 1:18, from 1:5 to 1:16, from 1:5 to 1:14, from 1:5 to 1:12, from 1:7 to 1:20, from 1:9 to 1:20, from 1:6 to 1:18, from 1:7 to 1:16, from 1:8 to 1:14, from 1:9 to 1:12. From 1:9 to 1:11, or any subset thereof. In embodiments, the ratio of subscript "m" to subscript "n" may be 1:10. It is believed that the ratio of phenol units (represented by subscript "m") to residues of propylene oxide (represented by subscript "n") may play a significant role in achieving the required solubility and performance (RSN and HLB) of the demulsifying agent.

In the demulsifying agent, a ratio of subscript "m" to subscript "p" (representing the molar ratio of phenol units to residues of glycidol) may be from 1:2 to 1:15. In embodiments, a ratio of subscript m to subscript p may be from 1:2 to 1:13, from 1:2 to 1:11, from 1:2 to 1:9, from 1:2 to 1:7, from 1:2 to 1:5, from 1:3 to 1:15, from 1:3 to 1:12, from 1:3 to 1:10, from 1:3 to 1:7, from 1:3 to 1:5, or any subset thereof. In embodiments, a ratio of subscript m to subscript p may be 1:4. It is believed that the ratio of phenol units (represented by subscript "m") to residues of glycidol (represented by subscript "p") may play a significant role in achieving the required solubility and performance (RSN and HLB) of the demulsifying agent. Further, these ratios of glycidol to phenol units may provide improved coalescence and flocculation of water droplets, relative to other ratios, due to the structure of the hyper-branched polyglycerol units formed.

In the demulsifying agent, a ratio of subscript "n" to subscript "p" (representing the molar ratio of residues of propylene oxide to residues of glycidol) may be from 1:3 to 10:1. In embodiments, the combined molar ratio of residues of propylene oxide to residues of glycidol may be from 1:3 to 10:1, from 2:3 to 10:1, from 4:3 to 10:1, from 2:1 to 10:1, from 5:2 to 10:1, from 1:3 to 15:2, from 1:3 to 5:1, from 1:3 to 5:2, from 1:3 to 15:2, from 4:3 to 5:1, from 2:1 to 3:1, or any subset thereof. In embodiments, the combined molar ratio of residues of propylene oxide to residues of glycidol may be 5:2. It is believed that increasing the number of glycidol residues outside this range, such as having ratios of subscript "n" to subscript "p" greater than 1:10, or greater than 1:4 may lead to an increase in the hydrophobicity of the demulsifying agent, decreasing its effectiveness as a demulsifying agent. Further, increasing the ratio of subscript "n" to subscript "p" outside the claimed ranges may cause the demulsifying agent to be insoluble in an aromatic solvent used to prepare the demulsifier formulation.

The weight averaged molecular weight of the demulsifying agent may be from 1,000 g/mol to 10,000 g/mol. In embodiments, the weight averaged molecular weight of the demulsifying agent may be from 1,000 g/mol to 9,000 g/mol, from 1,000 g/mol to 8,000 g/mol, from 1,000 g/mol to 7,000 g/mol, from 1,000 g/mol to 6,000 g/mol, from 2,000 g/mol to 10,000 g/mol, from 3,000 g/mol to 10,000 g/mol, from 4,000 g/mol to 10,000 g/mol, from 5,000 g/mol to 10,000 g/mol, from 2,000 g/mol to 9,000 g/mol, from 3,000 g/mol to 8,000 g/mol, from 4,000 g/mol to 7,000 g/mol, from 5,000 g/mol to 6,000 g/mol, or any subset thereof. The molecular weight of the demulsifying agent may be measured using gel permeation chromatography (GPC) or by calculating the ratios of the feed monomers.

The demulsifying agent may have a relative solubility number (RSN) of less than or equal to 10 mL of water per 30 mL of titration solvent and 1 g of demulsifying agent. In embodiments, the demulsifying agent may have an RSN of less than or equal to 9 mL of water, less than or equal to 8 mL of water, less than or equal to 7 mL of water, less than or equal to 6 mL of water, less than or equal to 5 mL of water, less than or equal to 4 mL of water, less than or equal to 3 mL of water, from 1 mL of water to 10 mL of water, from 1 mL of water to 5 mL of water, from 1 mL of water to 3 mL of water, or any subset thereof. Per 30 mL of titration solvent and 1 g of demulsifying agent.

A method of making the demulsifying agent may begin by making novolak solids. A method of making the novolak solids may comprise: combining a phenol compound with a first acid to form a phenol-acid solution; heating the phenol-acid solution at a novolak formation temperature for a novolak formation time; and combining paraformaldehyde with the phenol-acid solution to form a formaldehyde solution comprising the novolak solids. Without being limited by theory, it is believed that formaldehydes other than paraformaldehyde may block the polymerization sites and render the polymerization ineffective.

The first acid may comprise any strong acid, such as a mineral acid, such as sulfuric acid, hydrochloric acid, hydrobromic acid, hydroiodic acid, nitric acid, perchloric acid, or chloric acid. In embodiments, the first acid may be sulfuric acid. The first acid may be concentrated acid, such as acid having a concentration from 30% to 98%. In embodiments, the first acid may be acid having a concentration of 98%.

The novolak formation temperature may be from 60° C. to 100° C., such as from 60° C. to 90° C., from 70° C. to 100° C., from 70° C. to 90° C., or about 80° C. The novolak formation time may be from 5 min. to 120 min., such as from 5 min. to 100 min., from 5 min. to 80 min. from 5 min. to 60 min., from 5 min. to 40 min., from 10 min. to 120 min., from 10 min. to 80 min., from 10 min. to 60 min., from 10 min. to 40 min., from 20 min. to 120 min., from 20 min. to 80 min., from 20 min. to 40 min., or about 30 min.

The phenol may comprise any phenol having structure XII, where $R_1$ is as described above. In embodiments, the phenol may comprise p-nonylphenol.

Structure XII

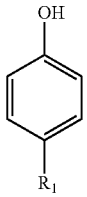

The method of making the demulsifying agent may further comprise drying the formaldehyde solution to isolate the novolak solids. Drying the formaldehyde solution to isolate the novolak solids may comprise heating the formaldehyde solution to a temperature of from 50° C. to 90° C., such as from 60° C. to 80° C., from 65° C. to 75° C., or from 68° C. to 72° C. Drying the formaldehyde isolate the novolak solids may comprise heating the formaldehyde solution under a vacuum, such as a vacuum of 0.1 bar, 0.2 bar, 0.5 bar, 1 bar, 1.5 bar, or 2 bar. Drying the formaldehyde solution to isolate the novolak solids may comprise heating the formaldehyde solution under a vacuum for a drying time, such as from 0.1 hr. to 12 hr., from 0.1 hr. to 6 hr., from 0.1 hr. to 3 hr., from 0.1 hr. to 2 hr., from 0.5 hr. to 12 hr., from 0.5 hr. to 6 hr., from 0.5 hr. to 3 hr., from 1 hr. to 12 hr., from 1 hr. to 6 hr., from 1 hr. to 3 hr., from 1.5 hr. to 2.5 hr., from 1.9 hr. to 2.1 hr., or any subset thereof. Drying the formaldehyde solutions to isolate the novolak solids may further comprise introducing a stream of $N_2$ to the formaldehyde solution prior and during heating of the formaldehyde solution. The presence of the nitrogen stream may help to eliminate moisture and oxygen from the solution.

A method of making the demulsifying agent may comprise combining the novolak solids with an aprotic solvent, a weak base, and an alcohol to form a novolak solution; drying the novolak solution to form a novolak residue; combining the novolak residue with propylene oxide under stirring to form a novolak-propylene oxide solution; reacting the novolak-propylene oxide solution to form a novolak-polypropylene oxide (PPO) solution; combining the novolak-PPO solution with glycidol to form a novolak-PPO-glycidol solution; reacting the novolak-PPO-glycidol solution to form a novolak-PPO-Hyper-branched polyglycerol (HPG) solution; and drying the novolak-PPO-HPG solution to form the demulsifying agent.

The alcohol may comprise an aliphatic alcohol, such as methanol, ethanol, propanol, or butanol. In embodiments, the alcohol may comprise methanol.

The aprotic solvent may comprise any suitable solvent lacking OH and NH moieties, such as acetone, acetonitrile, dichloromethane, dimethylformamide, dimethylpropyleneurea, dimethyl sulfoxide, ethyl acetate, hexamethylphosphoramide, pyridine, sulfolane, tetrahydrofuran, or dioxane. In embodiments, the aprotic solvent may comprise cyclic aprotic solvents, such as dioxane. Without being limited by theory, it is believed that cyclic aprotic solvents may provide superior stability, boiling points, and reaction times, relative to other solvent.

The weak base may comprise any suitable weak base, such as potassium methoxide, sodium formate, sodium methoxide, or potassium formate. In embodiments, the weak base may comprise potassium formate.

The novolak solution comprising the weak base may have a molar ratio of phenol monomers (as part of the novolak polymer) to potassium formate of from 3:5 to 12:5, such as from 5:5 to 12:5, from 7:5 to 12:5, from 3:5 to 10:5, from 3:5 to 8:5, from 6:5 to 10:5, or any subset thereof. In embodiments, the molar ratio of phenol monomers:potassium formate may be 1:0.6.

Combining novolak solids with the aprotic solvent, the weak base, and the alcohol to form the novolak solution may comprise mixing the aprotic solvent, weak base, and alcohol under stirring at a mixing temperature and for a mixing time. The mixing temperature may be from 25° C. to 95° C., such as from 35° C. to 85° C., from 45° C. to 75° C., from 55° C. to 75° C., from 60° C. to 70° C., or any subset thereof. The mixing time may be from 1 minute (min.) to 100 min., from 1 min. to 80 min., from 1 min. to 60 min., from 1 min. to 40 min., from 1 min. to 20 min., from 1 min. to 15 min., from 1 min. to 11 min., 5 min. to 100 min., from 5 min. to 80 min., from 5 min. to 60 min., from 5 min. to 40 min., from 5 min. to 20 min., from 5 min. to 15 min., from 5 min. to 11 min., 9 min. to 100 min., from 9 min. to 80 min., from 9 min. to 60 min., from 9 min. to 40 min., from 9 min. to 20 min., from 9 min. to 15 min., from 9 min. to 11 min., or any subset thereof.

Drying the novolak solution to form the novolak residue may comprise heating the novolak solution to a temperature of from 50° C. to 90° C., such as from 60° C. to 80° C., from 65° C. to 75° C., or from 68° C. to 72° C. Drying the novolak solution to form the novolak residue may comprise heating the novolak solution under a vacuum, such as a vacuum of 0.1 bar, 0.2 bar, 0.5 bar, 1 bar, 1.5 bar, or 2 bar. Drying the novolak solution to form the novolak residue may comprise heating the novolak solution under a vacuum for a drying time, such as from 0.1 hr. to 12 hr., from 0.1 hr. to 6 hr., from 0.1 hr. to 3 hr., from 0.1 hr. to 2 hr., from 0.5 hr. to 12 hr., from 0.5 hr. to 6 hr., from 0.5 hr. to 3 hr., from 1 hr. to 12 hr., from 1 hr. to 6 hr., from 1 hr. to 3 hr., from 1.5 hr. to 2.5 hr., from 1.9 hr. to 2.1 hr., or any subset thereof. Drying the novolak solution to form a novolak residue may further comprise introducing a stream of $N_2$ to the novolak solution prior and during heating of the novolak solution. The presence of the nitrogen stream may help to eliminate moisture and oxygen from the solution.

Reacting the novolak-propylene oxide solution to form the novolak-PPO solution may comprise stirring the novolak-PPO solution at a temperature of from 60° C. to 99° C., such as from 70° C. to 90° C., from 75° C. to 85° C., from 79° C. to 81° C. or any subset thereof, for a reaction time of from 1 hr. to 12 hr., from 3 hr. to 9 hr., from 5 hr. to 7 hr., or any subset thereof. Reacting the novolak-propylene oxide solution to form a novolak-PPO solution may further comprise heating the novolak-propylene oxide solution to a temperature of from 70° C. to 99° C., from 80° C. to 99° C., from 85° C. to 95° C., from 89° C. to 91° C., or any subset thereof, for a further 12 hr. to 36 hr., such as 18 hr. to 30 hr., 20 hr. to 28 hr., 22 hr. to 26 hr., or about 24 hr.

Reacting the novolak-PPO-glycidol solution to form a novolak-PPO-HPG solution may comprise heating the novolak-PPO-glycidol solution at a temperature of from 60° C. to 99° C., such as from 70° C. to 90° C., from 75° C. to 85° C., from 79° C. to 81° C. or any subset thereof, for a reaction time of from 1 hr. to 12 hr., from 3 hr. to 9 hr., from 5 hr. to 7 hr., or any subset thereof; and then further heating the novolak-PPO-glycidol solution at a temperature of from 70° C. to 99° C., from 80° C. to 99° C., from 85° C. to 95° C., from 89° C. to 91° C., or any subset thereof, for a further 12 hr. to 36 hr., such as 18 hr. to 30 hr., 20 hr. to 28 hr., 22 hr. to 26 hr., or about 24 hr.

Drying the novolak-PPO-HPG solution to form the demulsifying agent may comprise heating the novolak-PPO-HPG solution to a temperature of from 50° C. to 90° C., such as from 60° C. to 80° C., from 65° C. to 75° C., or from 68° C. to 72° C. Drying the novolak-PPO-HPG solution to form the demulsifying agent may further comprise heating the novolak-PPO-HPG solution under a vacuum, such as a vacuum of 0.1 bar, 0.2 bar, 0.5 bar, 1 bar, 1.5 bar, or 2 bar for a drying time, such as from 0.1 hr. to 12 hr., from 0.1 hr. to 6 hr., from 0.1 hr. to 3 hr., from 0.1 hr. to 2 hr., from 0.5 hr. to 12 hr., from 0.5 hr. to 6 hr., from 0.5 hr. to 3 hr., from 1 hr. to 12 hr., from 1 hr. to 6 hr., from 1 hr. to 3 hr., from 1.5 hr. to 2.5 hr., from 1.9 hr. to 2.1 hr., or any subset thereof. Drying the novolak-PPO-HPG solution may further comprise introducing a stream of $N_2$ to the novolak-PPO-HPG solution during the drying process, prior to heating the novolak-PPO-HPG solution.

A method of demulsifying a hydrocarbon emulsion may comprise combining a hydrocarbon feed with the demulsifying agent to form a hydrocarbon-demulsifying agent solution; wherein the hydrocarbon feed may comprise water and hydrocarbons.

The hydrocarbon feed may include one or more heavy oils, such as but not limited to crude oil, bitumen, oil sand, shale oil, coal liquids, vacuum residue, tar sands, other heavy oil streams, or combinations of these heavy oils. It should be understood that, as used in this disclosure, a "heavy oil" refers to a raw hydrocarbon, such as whole crude oil, which has not been previously processed through distillation, or may refer to a hydrocarbon oil, which has undergone some degree of processing prior to being introduced to the process as the hydrocarbon feed. The hydrocarbon feed may have a density of greater than or equal to 0.80 grams per milliliter. The hydrocarbon feed may have an end boiling point (EBP) of greater than 565° C. The hydrocarbon feed may have a concentration of nitrogen of less than or equal to 3,000 parts per million by weight (ppmw).

In embodiments, the hydrocarbon feed may be a crude oil, such as whole crude oil, or synthetic crude oil. The crude oil may have an American Petroleum Institute (API) gravity of from 22 degrees to 52 degrees, such as from 25 degrees to 52 degrees, from 22 degrees to 40 degrees, from 25 degrees to 50 degrees, or from 25 degrees to 40 degrees. In embodiments, the hydrocarbon feed may include an extra light crude oil, a light crude oil, a heavy crude oil, or combinations of these. In embodiments, the hydrocarbon feed can be a light crude oil, such as but not limited to an Arab heavy crude oil, an Arab medium crude oil, an Arab light (AL) export crude oil, an Arab extra light crude oil, or an Arab super light crude oil. The hydrocarbon feed may have a sulfur content of from 0.05 wt. % to 3 wt. %. In embodiments, the hydrocarbon feed may have a sulfur content of from 0.05 wt. % to 2.75 wt. %, from 0.05 wt. % to 2.50 wt. %, from 0.05 wt. % to 2.25 wt. %, from 0.05 wt. % to 2.00 wt. %, from 0.1 wt. % to 3 wt. %, from 0.5 wt. % to 3 wt. %, from 1 wt. % to 3 wt. %, from 1.5 wt. % to 3 wt. %, from 1.5 wt. % to 2.5 wt. %, or any subset thereof.

When the hydrocarbon feed comprises a crude oil, the crude oil may be a whole crude or may be a crude oil that has undergone at least some processing, such as desalting, solids separation, or scrubbing. In embodiments, the hydrocarbon feed may be a de-salted crude oil that has been subjected to a de-salting process. In embodiments, the hydrocarbon feed may include a crude oil that has not undergone pretreatment, separation (such as distillation), or other operation or process that changes the hydrocarbon composition of the crude oil prior to introducing the crude oil to the process.

In embodiments, the hydrocarbon feed can be a crude oil having a boiling point profile as described by the 5 wt. % boiling temperature, the 25 wt. % boiling temperature, the 50 wt. % boiling temperature, the 75 wt. % boiling temperature, and the 95 wt. % boiling temperature. These respective boiling temperatures correspond to the temperatures at which a given weight percentage of the hydrocarbon feed stream boils. In embodiments, the crude oil may have one or more of a 5 wt. % boiling temperature of less than or equal to 150° C.; a 25 wt. % boiling temperature of less than or equal to 225° C. or less than or equal to 200° C.; a 50 wt. % boiling temperature of less than or equal to 500° C., less than or equal 450° C., or less than or equal to 400° C.; a 75 wt. % boiling temperature of less than 600° C., less than or equal to 550° C.; a 95 wt. % boiling temperature of greater than or equal to 550° C. or greater than or equal to 600° C.; or combinations of these. In embodiments, the crude oil may have one or more of a 5 wt. % boiling temperature of from 0° C. to 100° C.; a 25 wt. % boiling temperature of from 150° C. to 250° C., a 50 wt. % boiling temperature of from 250° C. to 400° C., a 75 wt. % boiling temperature of from 350° C. to 600° C. and an end boiling point temperature of from 500° C. to 1000° C., such as from 500° C. to 800° C.

The hydrocarbon feed may comprise at least 1 wt. % water, such as at least 5 wt. %, at least 10 wt. %, at least 15 wt. %, at least 20 wt. %, at least 30 wt. %, at least 40 wt. %, at least 50 wt. %, from 1 wt. % to 90 wt. %, from 1 wt. % to 75 wt. %, from 1 wt. % to 60 wt. %, from 1 wt. % to 50 wt. %, from 1 wt. % to 25 wt. %, from 10 wt. % to 90 wt. %, from 10 wt. % to 80 wt. %, from 10 wt. % to 70 wt. %, from 10 wt. % to 60 wt. %, from 25 wt. % to 90 wt. %, from 25 wt. % to 80 wt. %, from 25 wt. % to 70 wt. %, from 25 wt. % to 60 wt. %, from 40 wt. % to 90 wt. %, from 40 wt. % to 80 wt. %, from 40 wt. % to 70 wt. %, from 40 wt. % to 60 wt. %, or any subset thereof, of water, based on the total weight of water and hydrocarbons in the hydrocarbon feed. The hydrocarbon feed may be an emulsion, such as an oil in water emulsion.

The hydrocarbon-demulsifying agent solution may comprise from 10 ppm to 1000 ppm, such as from 10 ppm to 750 ppm, from 10 ppm to 500 ppm, from 10 ppm to 300 ppm, from 10 ppm to 250 ppm, from 10 ppm to 200 ppm, from 25 ppm to 1000 ppm, from 25 ppm to 750 ppm, from 25 ppm to 500 ppm, from 25 ppm to 250 ppm, from 25 ppm to 200 ppm, from 50 ppm to 1000 ppm, from 50 ppm to 750 ppm, from 50 ppm to 500 ppm, from 50 ppm to 300 ppm, from 50 ppm to 250 ppm, from 50 ppm to 200 ppm, from 100 ppm to 1000 ppm, from 100 ppm to 500 ppm, from 100 ppm to 250 ppm, from 100 ppm to 200 ppm, from 150 ppm to 1000 ppm, from 150 ppm to 500 ppm, from 150 ppm to 250 ppm, from 150 ppm to 200 ppm, from 175 ppm to 250 ppm, from 175 ppm to 225 ppm, from 175 ppm to 200 ppm, or any subset thereof, of the hydrocarbon-demulsifying agent.

The method of demulsifying a hydrocarbon emulsion may further comprise agitating the hydrocarbon-demulsifying agent solution, such as by shaking, stirring, blending, or otherwise inducing turbulent flow conditions within the hydrocarbon-demulsifying agent solution.

The hydrocarbon-demulsifying agent solution may further comprise an aromatic compound, an alcohol, or both. The alcohol may comprise an aliphatic alcohol, such as methanol, ethanol, propanol, iso-propanol, butanol, or combinations of these. In embodiments, the alcohol may comprise methanol. The aromatic compound may comprise xylene, toluene, heavy aromatic solvents, and combinations thereof. In embodiments, the aromatic compound may comprise xylene.

The hydrocarbon-demulsifying agent solution may comprise from 5 volume percent (vol. %) to 25 vol. % of the aromatic compound, based on the total volume of the hydrocarbon emulsion and the aromatic compound. In embodiments, the hydrocarbon-demulsifying agent solution may comprise from 5 vol. % to 20 vol. %, from 10 vol. % to 25 vol. %, from 10 vol. % to 20 vol. %, from 12 vol. % to 18 vol. %, or any subset thereof of the aromatic compound, based on the total volume of the hydrocarbon emulsion and the aromatic compound.

The hydrocarbon-demulsifying agent solution may comprise from 0.1 wt. % to 5 wt. % of the alcohol. In embodiments, the hydrocarbon-demulsifying agent solution may comprise from 0.1 wt. % to 4 wt. %, from 0.1 wt. % to 3 wt. %, from 0.1 wt. % to 2 wt. %, from 0.1 wt. % to 1 wt. % from 0.1 wt. % to 0.75 wt. %, from 0.5 wt. % to 5 wt. %, 0.5 wt. % to 4 wt. %, from 0.5 wt. % to 3 wt. %, from 0.5 wt. % to 2 wt. %, from 0.5 wt. % to 1 wt. % from 0.5 wt. % to 0.75 wt. %, or any subset thereof, of alcohol, based on the total weight of hydrocarbons in the hydrocarbon-demulsifying agent solution.

The method of demulsifying a hydrocarbon emulsion may comprise allowing the hydrocarbon-demulsifying agent solution to settle. Settling may refer to the breakdown of the hydrocarbon emulsion into a separate oil phase and a water phase. Settling of the hydrocarbon-demulsifying agent solution may cause at least 30 wt. %, such as at least 40 wt. %, at least 50 wt. %, or at least 60 wt. % of the water in the hydrocarbon-demulsifying agent solution to leave the emulsion and form a separate aqueous phase.

Aspects

According to a first aspect of the present disclosure, a demulsifying agent may comprise the structure

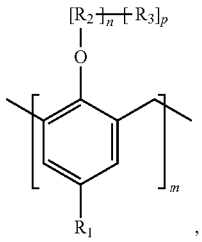

wherein: $R_1$ may be a hydrocarbyl group or heterohydrocarbyl group comprising from 1 to 20 carbon atoms; subscript "m" may be from 2 to 10, subscript "n" may be from 5 to 20; subscript "p" may be from 2 to 15; $R_2$ may comprise a residue of propylene oxide; and $R_3$ may comprise a residue of glycidol.

According to a second aspect of the present disclosure, in conjunction with the first aspect, $R_2$ may be a hydrocarbyl group of structure —(—$CH_2$—$CHCH_3$—O—).

According to a third aspect of the present disclosure, in conjunction with the first or second aspects, each $R_3$ group may be independently a hydrocarbyl group of structure IV, V, or VI; wherein structure IV

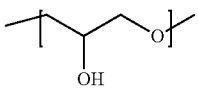

-continued structure V

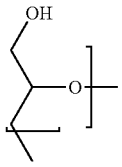

Structure VI

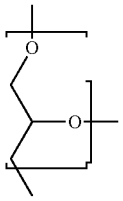

According to a fourth aspect of the present disclosure, in conjunction with any one of aspects 1-3, $R_1$ may be a hydrocarbyl group with from 5 to 15 carbon atoms.

According to a fifth aspect of the present disclosure, in conjunction with any one of aspects 1-4, a ratio of subscripts m:p may be from 1:2 to 1:15.

According to a sixth aspect of the present disclosure, in conjunction with any one of aspects 1-5, a ratio of subscripts m:n may be from 1:5 to 1:20.

According to a seventh aspect of the present disclosure, in conjunction with any one of aspects 1-6, a ratio of subscripts n:p may be from 10:1 to 1:3.

According to an eighth aspect of the present disclosure, in conjunction with any one of aspects 1-7, a weight averaged molecular weight of the demulsifying agent may be from 1,000 g/mol to 10,000 g/mol.

According to a ninth aspect of the present disclosure, in conjunction with any one of aspects 1-8, $R_2$ may be a hydrocarbyl group of structure —(—$CH_2$—$CHCH_3$—O—); $R_1$ may be a hydrocarbyl group with from 5 to 15 carbon atoms; a ratio of subscripts n:p may be from 5:1 to 5:3; a ratio of subscripts m:n may be from 1:8 to 1:12; a ratio of subscripts m:p may be from 1:3 to 1:5; a weight averaged molecular weight of the demulsifying agent may be from 1,000 g/mol to 10,000 g/mol; and each $R_3$ group may be independently a hydrocarbyl group of structure IV, structure V, or structure VI; where structure IV

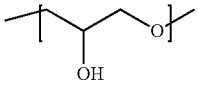

structure V

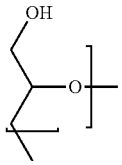

Structure VI

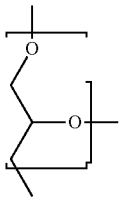

According to an tenth aspect of the present disclosure, in conjunction with any one of aspects 1-9, a method of making the demulsifying agent of claim 1 may comprise combining novolak solids with an aprotic solvent, a weak base, and an alcohol to form a novolak solution; drying the novolak solution to form a novolak residue; combining the novolak residue with propylene oxide under stirring to form a novolak-propylene oxide solution; reacting the novolak-propylene oxide solution to form a novolak-PPO solution; combining the novolak-PPO solution with glycidol to form a novolak-PPO-glycidol solution; reacting the novolak-PPO-glycidol solution to form a novolak-PPO-HPG solution; and drying the novolak-PPO-HPG solution to form the demulsifying agent.

According to an eleventh aspect, in conjunction with the tenth aspect, the method of making the demulsifying agent may further comprise combining a phenol compound with a first acid to form a phenol-acid solution; heating the phenol-acid solution at a temperature of about 80° C. for about 30 minutes; and combining paraformaldehyde with the phenol-acid solution to form a formaldehyde solution comprising the novolak solids.

According to a twelfth aspect, in conjunction with the eleventh aspect, the phenol compound may comprise p-nonylphenol.

According to a thirteenth aspect, in conjunction with any one of aspects 10-12, the aprotic solvent may comprise dioxane.

According to a fourteenth aspect, in conjunction with any one of aspects 10-13, the weak base may comprise potassium formate.

According to a fifteenth aspect, in conjunction with any one of aspects 1-14, a method of demulsifying a hydrocarbon emulsion may comprise combining a hydrocarbon feed with the demulsifying agent to form a hydrocarbon-demulsifying agent solution; wherein the hydrocarbon feed may comprise water and hydrocarbons.

According to a sixteenth aspect, in conjunction with the fifteenth aspect, the hydrocarbon feed may comprise a crude oil.

According to a seventeenth aspect, in conjunction with the fifteenth or sixteenth aspects, the hydrocarbon-demulsifying agent solution may comprise from 10 to 200 ppm of the demulsifying agent.

According to an eighteenth aspect, in conjunction with any one of aspects 15-17, the hydrocarbon-demulsifying agent solution may further comprise an aromatic compound, an alcohol, or both.

According to a nineteenth aspect, in conjunction with any one of aspects 15-8, the aromatic compound may comprise xylene and the alcohol comprises methanol.

According to a twentieth aspect, in conjunction with any one of aspects 15-19, the hydrocarbon feed may be a water in oil emulsion.

EXAMPLES

The various aspects of the present disclosure will be further clarified by the following examples. The examples are illustrative in nature and should not be understood to limit the subject matter of the present disclosure.

Example 1 (Ex-1) Novolak Synthesis

In Ex-1, a novolak compound of the present disclosure was prepared. A solution of p-nonylphenol (branched) (20.5 g, 93 mmol) (structure XIII) in cyclohexane (110 mL) was prepared. Then, 260 mg of concentrated $H_2SO_4$ (98%) was added to the solution. The resulting solution was stirred using a magnetic stir bar under $N_2$ at 80° C. for 30 min.

Structure XIII

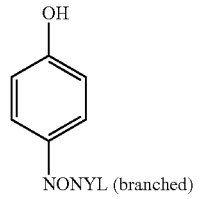

Then, powdered paraformaldehyde (2.79 g, 93 mmol) was added portion-wise at 80° C. over a period of 1 h. The solution was then refluxed for 4 h using a Dean-Stark apparatus to remove moisture. Next, the reaction mixture was filtered to remove minor black particles. Solvent was then removed from the filtrate by drying under vacuum at 50° C., which resulted in 21.5 g of brown-colored novolak solids (structure XIV).

Structure XIV

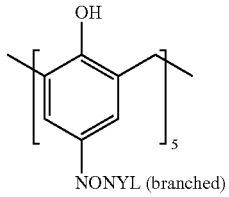

Example 2 (Ex-2)—Demulsifying Agent Synthesis

The novolak solids (8.0 g) of Ex-1 were dissolved in 18 g of anhydrous dioxane. Then the novolak-dioxane solution was added to a 20 wt. % potassium formate (5.61 g, 20 mmol) in methanol solution. The resultant mixture was stirred at 65° C. for 10 min. Then, using a gentle stream of nitrogen, the solvent was removed. The residual salts were then dried under vacuum at 70° C. for 2 hours to form a light brown solid. The light brown solid was a mixture of structure XIV and structure XV in a mass ratio of 20:14. This compound depicted in structure XV had an RSN of 10.2 mL of water.

Structure XV

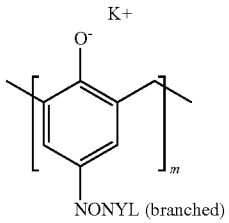

2.05 g (8.0 mmol) of the light brown solid was added to 14 ml of dioxane and heated to 70° C. Then using a gentle stream of $N_2$, the dioxane was removed.

4.65 g (80 mmol) of propylene oxide was combined with the now purified mixture of structures XIV and XV in a reaction vessel. The reaction vessel was sealed and the solution was stirred at 80° C. for 6 h and another 24 h at 90° C. $^1$H NMR revealed the almost complete consumption of propylene oxide.

Then, freshly distilled glycidol (2.37 g, 2.12 mL 32 mmol) was added dropwise under $N_2$ at 80° C. to the reaction vessel. The reaction mixture was then stirred at 95° C. for 24 h. After removal of the solvent and drying under vacuum at 70° C., preparation of the demulsifying agent was complete.

The prepared demulsifying agent had a molecular weight of about 5700 g/mol $^1$H-NMR spectra showed that the demulsifying agent was of structure XVI, with a ratio of m:n:p of 1:10:4, with m=5. Electrospray Ionization-Mass Spectrometry (ESI-MS) was performed on this compound and results are shown in FIG. 1.

The demulsifying agent of structure XVI prepared in Example 2 had a RSN of less than 3 mL of water per 30 mL of titration solvent and 1 g of demulsifying agent.

Structure XVI

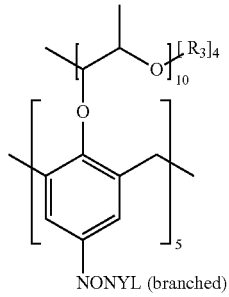

Example 3 (Ex-3)—Demulsifying Agent Performance Test

In Ex-3, 70 ml of a crude oil-water emulsion with 50 wt. % water and 50 wt. % hydrocarbons was obtained and transferred to a 100 ml graduated settling tube.

The demulsifying agent of Ex-2 (phenolic resin-polypropylene oxide-hyper-branched polypropylene glycol) was mixed with 10 ml of xylene and 0.5 ml of methanol to prepare a demulsifying agent solution which was 15 wt. % demulsifying agent, based on the total weight of the demulsifying agent solution. Sufficient demulsifying agent solution was added to the crude oil-water emulsion to obtain a demulsifying agent concentration of 200 ppm. The tube was shaken and allowed to settle at room temperature. Settling results are given in Table 3 below.

Comparative Example 4 (CE-4)—Comparative Demulsifying Agent Performance Test

In CE-4, 70 ml of a crude oil-water emulsion with 50 wt. % water and 50 wt. % hydrocarbons was obtained and transferred to a 100 ml graduated settling tube.

A demulsifying agent (phenolic resin-polypropylene oxide) of structure XVII and molecular weight (Mw) of about 4,300 g/mol was mixed with 10 ml of xylene and 0.5 ml of methanol to prepare a demulsifying agent solution which was 15 wt. % demulsifying agent, based on the total weight of the demulsifying agent solution. Sufficient demulsifying agent solution was added to the emulsion to obtain a demulsifying agent concentration of 200 ppm. The tube was shaken and allowed to settle at room temperature. Settling results are given in Table 3 below. The demulsifying agent of structure XVII prepared in Comparative Example 4 had a RSN of less than 3 mL of water.

Structure XVII

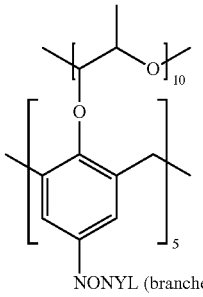

Comparative Example 5 (CE-5)—Comparative Demulsifying Agent Performance Test

In CE-5, 70 ml of a crude oil-water emulsion with 50 wt. % water and 50 wt. % hydrocarbons was obtained and transferred to a 100 ml graduated settling tube.

A demulsifying agent (phenolic resin-polypropylene oxide-polyethylene oxide) of structure XVIII and molecular weight (Mw) of about 5100 g/mol was mixed with 10 ml of xylene and 0.5 ml of methanol to prepare a demulsifying agent solution which was 15 wt. % demulsifying agent, based on the total weight of the demulsifying agent solution. Sufficient demulsifying agent solution was added to the emulsion to obtain a demulsifying agent concentration of 200 ppm. The tube was shaken and allowed to settle at room temperature. Settling results are given in Table 3 below. The demulsifying agent of structure XVIII prepared in Comparative Example 5 had a RSN of less than 3 mL of water.

Structure XVIII

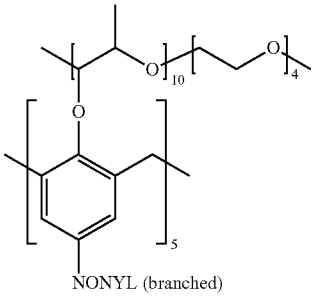

Comparative Example 6 (CE-6)—Control Emulsion Stability Testing

In CE-6, 70 ml of a crude oil-water emulsion a 58% water cut was obtained and transferred to a 100 ml graduated settling tube. No demulsifying agent was added to the mixture. The tube was shaken and allowed to settle at room temperature for 60 minutes. Settling results are given in Table 3 below. The amount of water removed is reported in mL. The amount of water removed was measured by observing the oil-water interface line in the graduated tube at the specified settling times.

The total water after centrifuge measurement was performed by centrifuging the entire sample. The amount of water which separated from the crude oil-water emulsion after centrifuging is reported as the "total water—after centrifuge." The total water—after centrifuge represents the maximum amount of water which could be separated from the crude oil-water emulsion. Efficiency is calculated as the ratio of water removed at a given time vs the total water after centrifuge.

TABLE 3

| Poly-mer | 10 min | 20 min | 30 min | 40 min | 50 min | 60 min | Total water-after centrifuge | Final Efficiency (%) |
|---|---|---|---|---|---|---|---|---|
| EX-3 | 4.5 | 7 | 8 | 9.5 | 10 | 11 | 18 | 61.1 |
| CE-4 | 0 | 0 | 0 | 0 | 0 | 0 | 18 | 0.0 |
| CE-5 | 0 | 0 | 0 | 0 | 0 | 0 | 18 | 0.0 |
| CE-6 | 0 | 0 | 0 | 0 | 0 | 0 | 18 | 0.0 |

As can be seen in Table 3, only the demulsifying agent of the present disclosure (EX-3) showed any effectiveness at breaking the hydrocarbon emulsion. The comparative examples CE-4 is a copolymer of novolak and polypropylene oxide (without hyper-branching), and thus does not have enough hydrophilic units in order to be effective as a demulsifying agent. Similarly, comparative example CE-5, which is a copolymer of novolak, propylene oxide, and ethylene oxide, performed no better than the control CE-6, due to its lack of hydrophilic groups. Additionally, the production of comparative example CE-5 exhibits increased flammability risks due to the presence of ethylene oxide. In contrast, the demulsifying agent EX-3 removed over 60% of the water in the hydrocarbon emulsion. This improvement is believed to be caused by the improved HLB, RSN, and hyper-branched structure of the present demulsifying agent. In particular, the hyper-branched structure of the present demulsifying agent is believed to provide better coalescence and flocculation of water droplets within the water in oil emulsion.

It is noted that any two quantitative values assigned to a property may constitute a range of that property, and all combinations of ranges formed from all stated quantitative values of a given property are contemplated in this disclosure.

It is noted that one or more of the following claims utilize the term "where" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

Having described the subject matter of the present disclosure in detail and by reference to specific aspects, it is noted that the various details of such aspects should not be taken to imply that these details are essential components of the aspects. Rather, the claims appended hereto should be taken as the sole representation of the breadth of the present disclosure and the corresponding scope of the various aspects described in this disclosure. Further, it will be apparent that modifications and variations are possible without departing from the scope of the appended claims.

What is claimed is:

1. A demulsifying agent comprising the structure

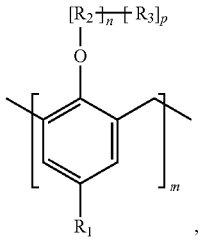

wherein:

$R_1$ is a hydrocarbyl group or heterohydrocarbyl group comprising from 1 to 20 carbon atoms;

subscript "m" is from 2 to 10, subscript "n" is from 5 to 20; subscript "p" is from 2 to 15;

$R_2$ comprises a residue of propylene oxide; and $R_3$ comprises a residue of glycidol.

2. The demulsifying agent of claim 1, wherein $R_2$ is a hydrocarbyl group of structure —(—$CH_2$—$CHCH_3$—O—).

3. The demulsifying agent of claim 1, wherein each $R_3$ group is independently a hydrocarbyl group of structure IV, V, or VI; wherein structure IV

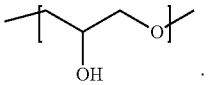

structure V

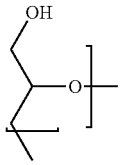

Structure VI

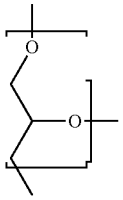

4. The demulsifying agent of claim 1, wherein $R_1$ is a hydrocarbyl group with from 5 to 15 carbon atoms.

5. The demulsifying agent of claim 1, wherein a ratio of subscripts m:p is from 1:2 to 1:15.

6. The demulsifying agent of claim 1, wherein a ratio of subscripts m:n is from 1:5 to 1:20.

7. The demulsifying agent of claim 1, wherein a ratio of subscripts n:p is from 10:1 to 1:3.

8. The demulsifying agent of claim 1, wherein a weight averaged molecular weight of the demulsifying agent is from 1,000 g/mol to 10,000 g/mol.

9. The demulsifying agent of claim 1, wherein:

$R_2$ is a hydrocarbyl group of structure —(—$CH_2$—$CHCH_3$—O—);

$R_1$ is a hydrocarbyl group with from 5 to 15 carbon atoms;

a ratio of subscripts n:p is from 5:1 to 5:3;

a ratio of subscripts m:n is from 1:8 to 1:12;

a ratio of subscripts m:p is from 1:3 to 1:5;

a weight averaged molecular weight of the demulsifying agent is from 1,000 g/mol to 10,000 g/mol; and wherein each $R_3$ group is independently a hydrocarbyl group of structure IV, structure V, or structure VI; where structure IV

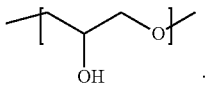

structure V

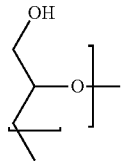

Structure VI

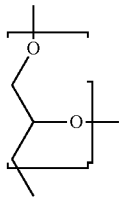

10. A method of making a demulsifying agent, the method comprising:

combining novolak solids with an aprotic solvent, a weak base, and an alcohol to form a novolak solution;

drying the novolak solution to form a novolak residue;

combining the novolak residue with propylene oxide under stirring to form a novolak-propylene oxide solution;

reacting the novolak-propylene oxide solution to form a novolak-PPO solution;

combining the novolak-PPO solution with glycidol to form a novolak-PPO-glycidol solution;

reacting the novolak-PPO-glycidol solution to form a novolak-PPO-HPG solution;

drying the novolak-PPO-HPG solution to form the demulsifying agent, wherein the demulsifying agent comprises the structure

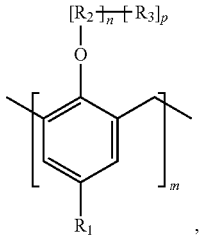

wherein:

$R_1$ is a hydrocarbyl group or heterohydrocarbyl group comprising from 1 to 20 carbon atoms;

subscript "m" is from 2 to 10, subscript "n" is from 5 to 20; subscript "p" is from 2 to 15;

$R_2$ comprises a residue of propylene oxide; and $R_3$ comprises a residue of glycidol.

11. A method of making the demulsifying agent of claim 10, further comprising:

combining a phenol compound with a first acid to form a phenol-acid solution;

heating the phenol-acid solution at a temperature of about 80° C. for about 30 minutes; and combining paraformaldehyde with the phenol-acid solution to form a formaldehyde solution comprising the novolak solids.

12. A method of making the demulsifying agent of claim 11, where the phenol compound comprises p-nonylphenol.

13. A method of making the demulsifying agent of claim 10, wherein the aprotic solvent comprises dioxane.

14. A method of making the demulsifying agent of claim 10, where the weak base comprises potassium formate.

15. A method of demulsifying a hydrocarbon emulsion, the method comprising combining a hydrocarbon feed with a demulsifying agent to form a hydrocarbon-demulsifying agent solution; wherein the hydrocarbon feed comprises water and hydrocarbons, wherein the demulsifying agent comprises the structure

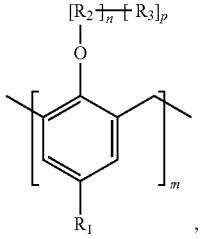

, wherein:

$R_1$ is a hydrocarbyl group or heterohydrocarbyl group comprising from 1 to 20 carbon atoms;

subscript "m" is from 2 to 10, subscript "n" is from 5 to 20; subscript "p" is from 2 to 15;

$R_2$ comprises a residue of propylene oxide; and $R_3$ comprises a residue of glycidol.

16. The method of demulsifying a hydrocarbon emulsion of claim 15, wherein the hydrocarbon feed comprises a crude oil.

17. The method of demulsifying a hydrocarbon emulsion of claim 15, wherein the hydrocarbon-demulsifying agent solution comprises from 10 to 200 ppm of the demulsifying agent.

18. The method of demulsifying a hydrocarbon emulsion of claim 15, wherein the hydrocarbon-demulsifying agent solution further comprises an aromatic compound, an alcohol, or both.

19. The method of demulsifying a hydrocarbon emulsion of claim 18, wherein the aromatic compound comprises xylene and the alcohol comprises methanol.

20. The method of demulsifying a hydrocarbon emulsion of claim 15, wherein the hydrocarbon feed is a water in oil emulsion.

* * * * *